United States Patent [19]

Perez et al.

[11] Patent Number: 4,736,975

[45] Date of Patent: Apr. 12, 1988

[54] METHOD AND APPARATUS FOR LOADING AND UNLOADING PALLETIZED LOADS

[75] Inventors: Louis H. Perez; John E. Moore, both of Lutz; Timothy Poe, Tampa; Martin Chapman, Lutz; Charles W. Stowe, Jr., Tampa, all of Fla.

[73] Assignee: Nabisco Brands, Inc., Parsippany, N.J.

[21] Appl. No.: 948,246

[22] Filed: Dec. 31, 1986

[51] Int. Cl.[4] ..... B66C 1/16; B66C 1/18

[52] U.S. Cl. ..... 294/81.55; 294/74

[58] Field of Search ..... 294/81.55, 81.5, 81.51, 294/81.52, 81.62, 81.12, 67.1, 67.4, 74; 414/730, 734, 756

[56] References Cited

U.S. PATENT DOCUMENTS

| | | | |
|---|---|---|---|
| 2,974,994 | 3/1961 | Goldsmith | 294/81.5 |
| 2,987,340 | 6/1961 | Mattera | 294/74 |

*Primary Examiner*—James B. Marbert

*Attorney, Agent, or Firm*—Richard Kornutik

[57] ABSTRACT

A sling for loading and unloading several palletized loads simultaneously comprises two pairs of spreader bars each having a plurality of teeth extending perpendicularly with respect to an elongate dimension of the respective spreader bar. The spreader bars are suspended by pairs of cables from a rectangular frame in turn supported by a plurality of support cables. The spreader bars are carried by the suspension cables so that the teeth project upwardly and inwardly from the respective spreader bar towards the associated bar of the respective pair.

1 Claim, 1 Drawing Sheet

METHOD AND APPARATUS FOR LOADING AND UNLOADING PALLETIZED LOADS

BACKGROUND OF THE INVENTION

This invention relates to a method and apparatus for loading and unloading palletized loads. More particularly, this invention relates to a sling for performing this function.

In the loading and unloading of palletized loads onto and from transport vehicles such as ships, the palletized loads are commonly placed on large metal support plates in turn carried by the cables of a hoisting mechanism. In order to move a palletized load pursuant to this method, an empty or unloaded plate is placed on a level surface near a palletized load which is then lifted and deposited on the plate.

A disadvantage of this conventional method of moving palletized loads is the extra time required for moving the loads onto empty carrier plates. This disadvantage is particularly apparent when there is a relatively limited supply of hoisting mechanisms and carrier plates available for loading or unloading a transport vehicle.

Recent improvements in the palletization of crates of vegetable goods such as bananas, e.g., the wrapping of a stack of crates in a helically wound plastic sheet, have rendered palletized loads increasingly stable and concomitantly enabled treatment of palletized loads as unitary objects.

In a particular improved apparatus for the loading and unloading of palletized goods, a pair of bars each having a plurality of teeth extending transversely to the elongate dimension of the respective bar are hung from a frame assembly so that the teeth of each bar point upwardly and inwardly towards the other bar. Palletized loads are supported on the teeth of the pair of bars, the teeth being inserted, during a loading operation, under the pallets to be moved.

An object of the present invention is to provide an improved method and apparatus for loading and unloading palletized loads.

Another, more particular, object of the present invention is to provide such a method and apparatus wherein several palletized loads are capable of being moved simultaneously by a single hoisting mechanism.

An even more particular object of the present invention is to provide such a method and apparatus wherein the several palletized loads to be moved need not be lifted in order to place the loads in an operative engagement with the moving apparatus.

SUMMARY OF THE INVENTION

An apparatus for loading and unloading palletized loads comprises, in accordance with the present invention, a plurality of pairs of cofunctioning spreader bars each including a plurality of parallel grappling teeth insertable under pallets. The spreader bars are suspended by a plurality of cables from a frame having a multiplicity of interconnected structural members lying in a common plane. The frame is supported in turn by another plurality of cables from a connection point on a side of the frame opposite the spreader bars. The cables in the second set are each pivotably connected at one end to the frame and at an opposite end substantially to the connection point. The spreader bars are suspended from the frame in such a way that the grappling teeth point upwardly towards the frame and inwardly from a respective one of the spreader bars towards a cofunctioning spreader bar of the same pair. Each of the cables supporting the spreader bars from the frame is pivotably connected at one end to the frame and at an opposite end to a respective spreader bar.

Preferably, the spreader bars are oriented parallel to one another in a suspended state of the spreader bars, while the pairs of spreader bars are disposed laterally adjacent one another.

An apparatus in accordance with the present invention is capable of moving several palletized loads simultaneously. None of the loads to be moved need be lifted in order to place the load into an operative engagement with the sling.

DETAILED DESCRIPTION

Figure 1:
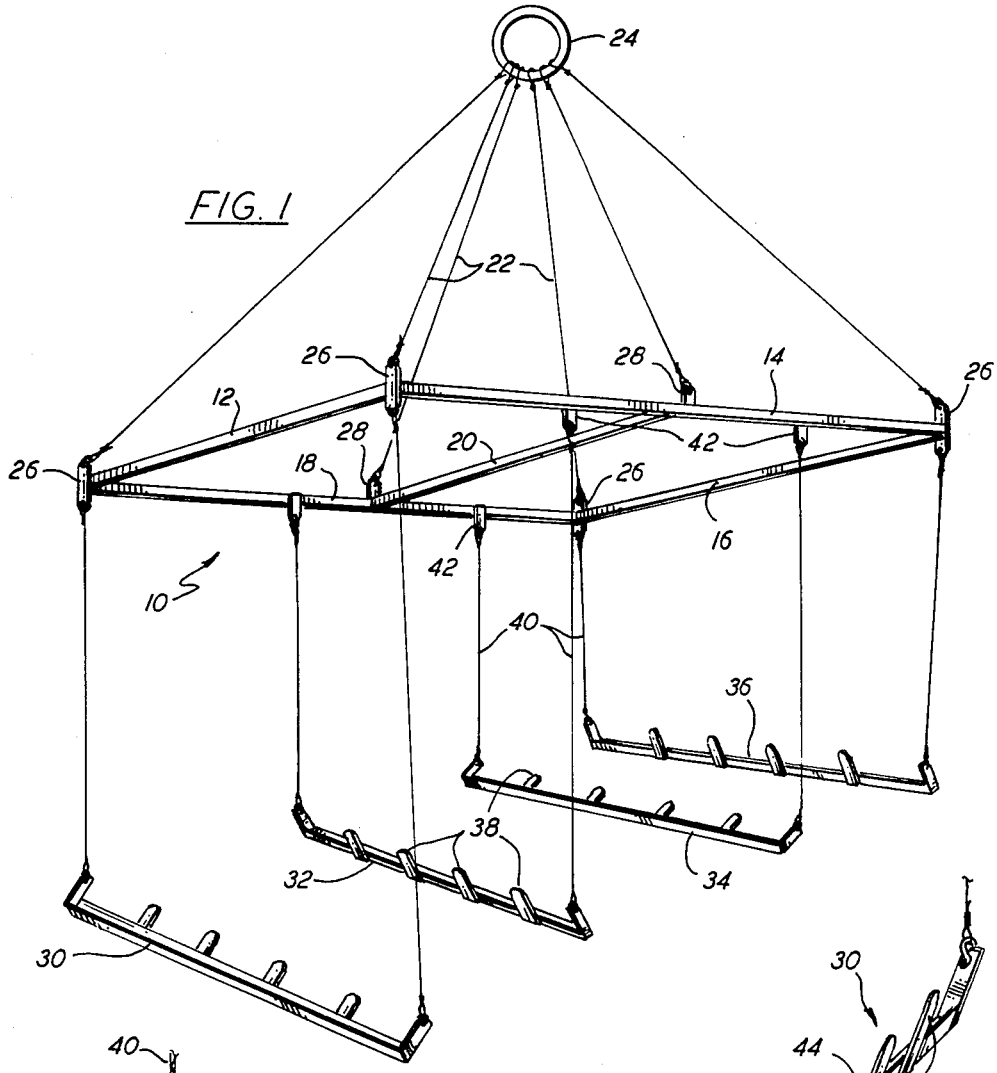
FIG. 1 is a perspective view of a sling with two pairs of spreader bars for moving several palletized loads, in accordance with the present invention.

As illustrated in FIG. 1, a sling for loading and unloading palletized loads exemplarily into and from the hold of a ship comprises a frame 10 having a multiplicity of interconnected structural members 12, 14, 16, 18 and 20 welded to one another to form a rectangular strucuture lying in a plane. A plurality of cables 22 are each pivotably connected at an upper end to a ring-shaped coupling member 24 and at lower ends to respective brackets 26 and 28. Four brackets 26 are provided at the corners of rectangular frame 10, while two further brackets 28 are provided at the ends of intermediate structural member 20 and midway along structural members 14 and 18.

As further illustrated in FIG. 1, the loading sling further comprises a first pair of cofunctioning spreader bars 30 and 32 and a second pair of cofunctioning spreader bars 34 and 36. Each spreader bar 30, 32, 34 and 36 includes a plurality of parallel grappling teeth 38 insertable under pallets (see FIG. 4). The spreader bars are suspended from frame 10 by means of respective pairs of cables 40 each pivotably connected at an upper end to a bracket 26 or 42 and at a lower end to a respective one of spreader bars 30, 32, 34 and 36. As set forth above, brackets 26 are attached to frame 10 at the corners thereof and have portions projecting above and below structural members 12 and 16, whereby cables 22 and 40 may be connected to the brackets. Two brackets 42 are disposed on frame member 14 and extend from a lower surface thereof, while two further, substantially identical brackets 42 are connected to structural member 18.

As depicted in FIG. 1, spreader bars 30, 32, 34 and 36 are suspended by cables 40 from frame 10 so that the grappling teeth 38 of any given spreader bar point upwardly towards frame 10 and inwardly from the given spreader bar towards the associated bar of the respective pair of spreader bars. Accordingly, teeth 38 of spreader bar 32 point upwardly and inwardly from bar 32 towards bar 30. Spreader bars 30, 32, 34 and 36 are oriented substantially parallel to one another in a suspended state of the spreader bars. Spreader bar pair 30, 32 is disposed laterally adjacent to spreader bar pair 34, 36.

Figure 3:
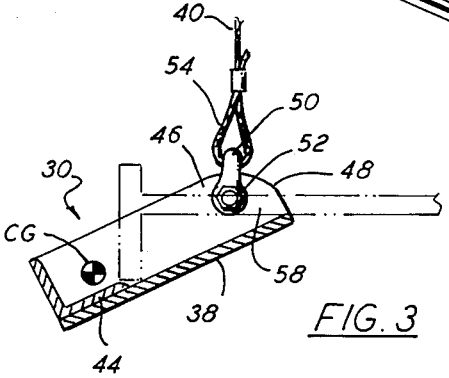
FIG. 3 is transverse cross-sectional view through the spreader bar of FIG. 2.
Figure 4:
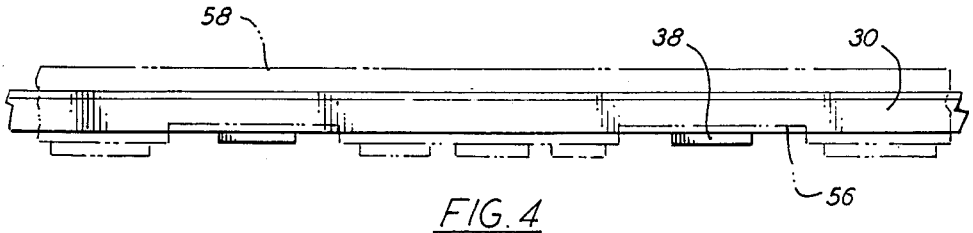
FIG. 4 is a partial side elevational view of a spreader bar in the sling assembly of FIG. 1, showing in dotdash lines a side elevational view of a pallet which coacts with a pair of opposed spreader bars to effectuate a lifting of a palletized load.

Although FIGS. 3 and 4 specifically show spreader bar 30, it is to be understood that spreader bars 30, 32, 34 and 36 are structurally identical. As shown in those drawing figures, spreader bar 30 includes an elongate rigid member 34 in the form of an angle beam or iron having a length substantially equal to the length of structural member 12 or 16 of frame 10 (see FIG. 1). Grappling teeth 38 are rigidly attached to an outer longitudinally extending surface of rigid angle member 34 and project in a transverse direction with respect to the angle member. As best seen in FIG. 1, grappling teeth 38 have rounded free ends. Teeth 38 of any particular spreader bar 30, 32, 34 or 36 are disposed in a common plane and are substantially equispaced from each other along the respective spreader bar.

Figure 2:
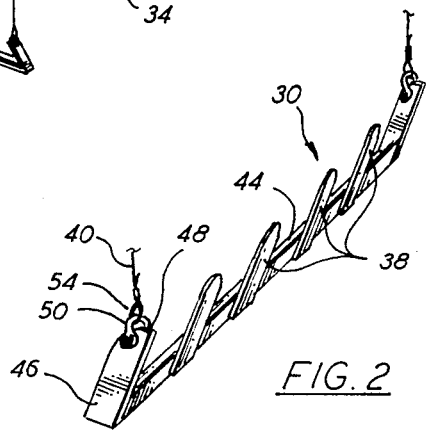
FIG. 2 is another perspective view of a spreader bar shown in FIG. 1, taken from a different angle and on an enlarged scale.

Each spreader bar, e.g., spreader bar 30 in FIG. 2, is provided at opposite ends with a pair of planar finger elements 46 rigidly attached to the angle member 44 and extending transversely with respect to an elongate dimension thereof. Finger elements 44 are disposed in respective additional planes oriented perpendicularly to the common plane occupied by the grappling teeth 38 of the respective spreader bar 30, 32, 34 or 36. As shown in FIGS. 2 and 3, each finger element has an arcuately beveled free end or edge 48 and is provided in the region of the arcuately beveled free end 48 with a respective C-shaped coupling hook 50 pivotably secured by a respective bolt 52. The lower ends of cables 40 are each formed with a loop 54 passing through a respective C-shaped hook 50.

FIG. 3 shows a point CG representing the center of gravity of spreader bar 30. The cables 40 attached to spreader bar 30 are pivotably fastened to the finger elements 46 of that spreader bar at coupling points (hooks 50) spaced from a line intersecting the center of gravity CG and extending parallel to rigid member 44 of the spreader bar. It is to be further noted that each coupling hook 50 is spaced from the plane containing grappling teeth 38 of the respective spreader bar and is disposed substantially on the same side of the center of gravity CG as the grappling teeth 38 whereby teeth 38 point upwardly when spreader bar 30 (or spreader bar 34, 36 or 38) is suspended from frame 10.

Spreader bars 30 and 32 are dimensioned so that they can lift two palletized loads. Spreader bars 34 and 36 are similarly dimensioned. In loading crates of produce, e.g., bananas, onto a ship for transport from a tropical area to a region of a more moderate climate, palletized stacks of banana crates are arranged side by side in spaced rows. In using the sling in accordance with the present invention, the sling is initially positioned so that spreader bars 30 and 32 are disposed over a pair of palletized crates in one row, while spreader bars 34 and 36 are disposed over another pair of palletized stacks of crates in another row. Frame 10 is then lowered so that the spreader bars touch the ground, whereupon spreader bars 30, 32, 34 and 36 are moved inwardly so that grappling teeth 38 are inserted under the palletized loads through respective cutouts 56 (see FIG. 4) in the side of a pallet 58. Upon insertion of grappling teeth 38, frame 10 is elevated, whereby teeth 38 catch against inner surfaces of the respective pallets 58 (see FIG. 3).

To unload the palletized stacks of crates or to disengage them from the sling illustrated in FIG. 1, the steps set forth above are performed in a reverse sequence.

Although the invention as been described in terms of particular embodiments and applications, one of ordinary skill in the art, in light of this teaching, can generate additional embodiments and modifications without departing from the spirit of or exceeding the scope of the claimed invention. Accordingly, it is to be understood that the descriptions and illustrations herein are proffered by way of example to facilitate comprehension of the invention and should not be construed to limit the scope thereof.

What is claimed is:

1. A sling for loading and unloading palletized loads, comprising:

a frame having a multiplicity of structural members lying in a common first plane, said frame having a substantially rectangular perimeter;

a plurality of first cables each pivotably connected at one end to said frame at said perimeter and at an opposite end substantially to a common connection point to define, in an operative state of the sling, a pyramidal form on one side of said frame;

a plurality of pairs of spreader bars, each of said bars including an elongate rigid member having a length substantially equal to a linear external dimension of said frame and a multiplicity of elongate planar teeth elements each rigidly attached to a lower longitudionally extending surface of said rigid member and extending in a transverse direction with respect thereto, said teeth elements being disposed in a common second plane and spaced from each other along the respective spreader bar, each of said bars further including a pair of planar finger elements rigidly attached to said rigid member and extending in said transverse direction, said finger elements being disposed at opposite ends of the respective one of said bars in respective third planes oriented substantially perpendicularly to said second plane; and a plurality of second cables each pivotably connected at one end to said frame at said perimeter and at an opposite end to a respective one of said finger elements, said second cables and said spreader bars being disposed on a side of said frame opposite said pyramidal form, each of said finger elements being coupled by a respective one of said second cables to said frame at said perimeter, said second cables being pivotably fastened to said finger elements at coupling points spaced from a line intersecting the center of gravity of the respective spreader bar and extending parallel to the rigid member of the respective spreader bar, each of said coupling points being spaced from the respective said second plane, each of said coupling points being disposed substantially on the same side of the respective spreader bar as the respective ones of said teeth elements so that such teeth elements point upwardly when the respective said spreader bars are suspended by said second cables from said frame, said spreader bars extending parallel to each other, the two spreader bars of each of said pairs of spreader bars being arranged so that the respective said teeth elements on one bar point inwardly substantially towards the other bar.

* * * * *